United States Patent [19]

Tarulli

[11] Patent Number: 4,619,626

[45] Date of Patent: Oct. 28, 1986

[54] SUPPORT AND TETHERED AMUSEMENT DEVICE

[76] Inventor: Gerald Tarulli, 29 Godfrey Rd. West, Weston, Conn. 06883

[21] Appl. No.: 696,587

[22] Filed: Jan. 31, 1985

[51] Int. Cl.[4] ..... A63H 21/02

[52] U.S. Cl. ..... 446/228

[58] Field of Search ..... 446/30, 34, 227, 230, 446/489, 232, 490, 177, 231, 228

[56] References Cited

U.S. PATENT DOCUMENTS

| | | | |
|---|---|---|---|
| 1,615,986 | 6/1926 | Knight | 446/489 |
| 1,900,691 | 3/1933 | Carlson | 446/227 X |
| 2,227,918 | 1/1941 | Trombla | 446/230 |
| 2,908,996 | 10/1959 | Humphrey | 446/34 X |
| 2,919,577 | 1/1960 | Cone | 446/34 X |
| 2,921,405 | 1/1960 | Perkins | 446/30 |

FOREIGN PATENT DOCUMENTS

| | | | |
|---|---|---|---|
| 661789 | 11/1951 | United Kingdom | 446/232 |

*Primary Examiner*—Mickey Yu

*Attorney, Agent, or Firm*—Fitzpatrick, Cella, Harper & Scinto

[57] ABSTRACT

A toy includes an object mountable in the field of view of the operator and above to be controlled relative to the contour of terrain more distant from the operator than the object and also within the operator's field of view, as the operator and terrain move relative to one another.

2 Claims, 4 Drawing Figures

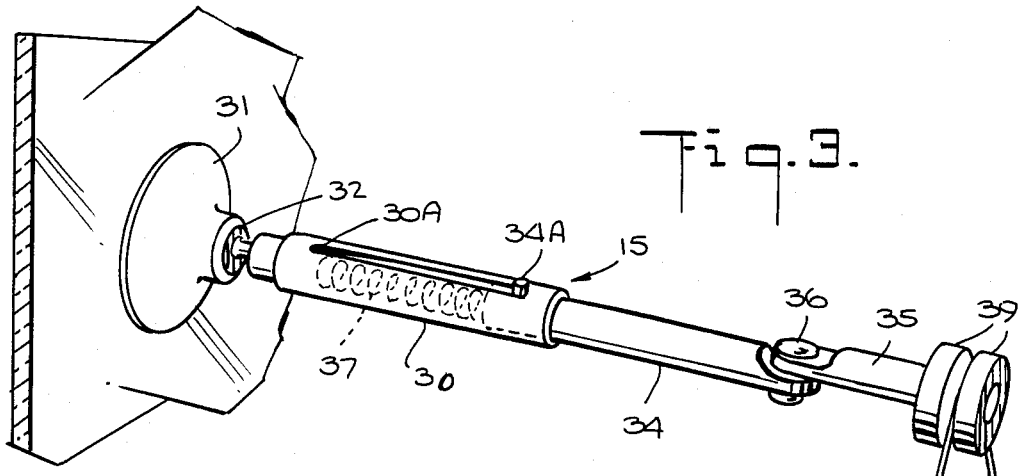
Fig. 3.
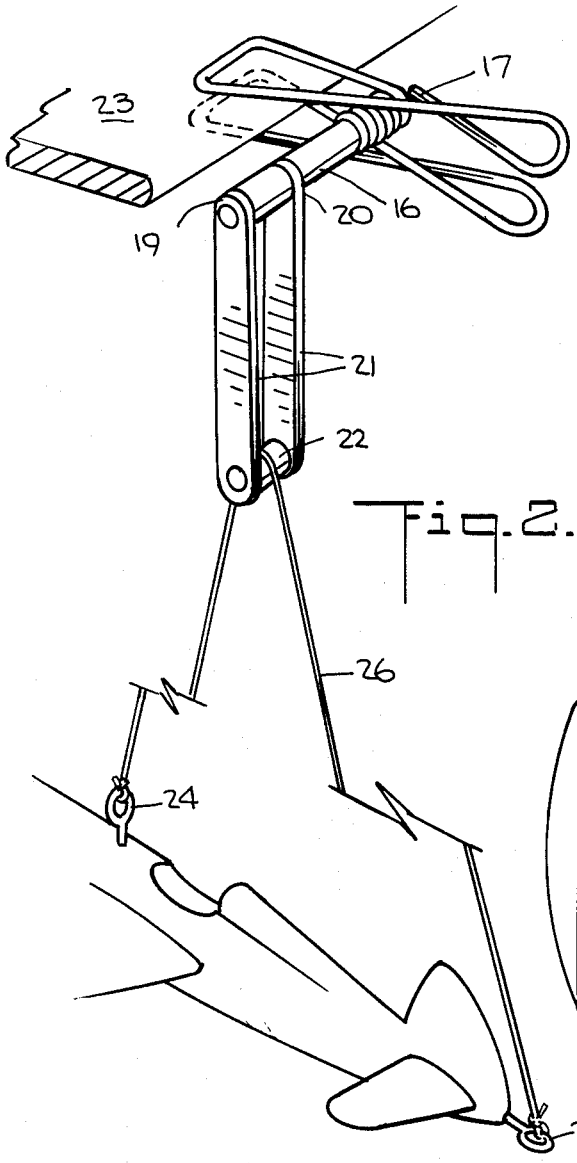
Fig. 2.
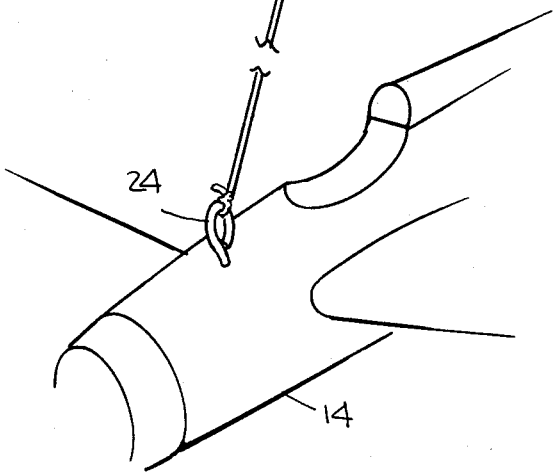
Fig. 4.
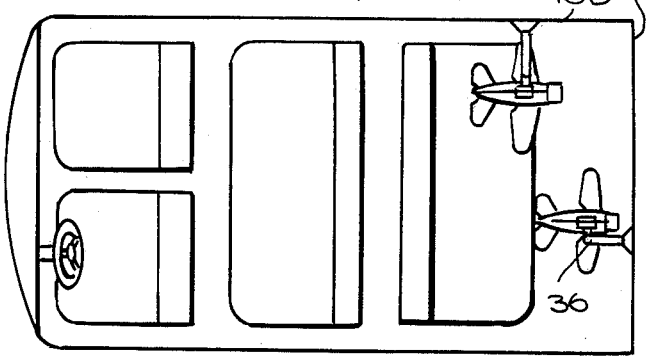

SUPPORT AND TETHERED AMUSEMENT DEVICE

BACKGROUND OF THE INVENTION

1. Field of the Invention

The present invention relates to an amusement device and a method of operating the same, and more particularly, to a device which includes an object such as a toy airplane mountable in the field of view of the operator and able to be controlled relative to the contour of terrain more distant from the operator than the object and as seen by the operator, as the operator and terrain move relative to one another. Thus, the object may be mounted in a vehicle adapted to move relative to the terrain, or the device may be used while it and the operator maintain fixed positions and an image of moving terrain is presented, on a television set, for example.

2. Description of the Prior Art

According to the teaching of U.S. Pat. No. 1,615,986, it is known to provide an amusement device comprising an object such as a toy airplane having a continuous longitudinal bore therethrough, a string attached at one end to the body of the airplane at the forward end of the bore and extending through an eye attached to a vertical support and rearwardly through the bore to a pull ring. A pull exerted on the ring causes the object to move toward the vertical support simulating the flight of an airplane.

This device merely causes the toy airplane to advance more or less horizontally a short distance with no reference to any varying contour moving relative to the object and the operator.

U.S. Pat. No. 2,478,695 discloses a toy airplane that may be raised or lowered by exerting a force on a string to raise the airplane and allowing gravity to lower it. As the device moves vertically, a shaft extending longitudinally in the body of the toy is rotated to turn a propeller.

According to U.S. Pat. No. 3,600,843, one end of a support line is fixed at a given height and a vehicle, such as a toy airplane, is equipped with a support movably engaging and supported by the support line. A movable vertical support is connected to the other end of the support line at a second given height and is able, by manipulation, to adjust the degree of slack of the support line to regulate the rate of descent of the vehicle along the support line. A landing surface is positioned below a portion of the support line, the purpose being to control the rate of descent of the vehicle and attempt to cause it to descend to the landing surface.

None of the above-described devices involves control of an object relative to the contour of terrain more distant from the operator than the object, both the object and terrain being within the field of view of the operator as the object and operator move together relative to the terrain such as where the object and operator are in a moving vehicle.

Other teachings of interest may be found in U.S. Pat. Nos. 2,227,918 and 2,908,996.

SUMMARY OF THE INVENTION

I have conceived and contribute by the present invention a toy of the class described, the operation of which I believe to be more challenging and entertaining than those of the prior art of which I am aware. My invention also encompasses a method of manipulating or operating the toy.

Thus, I provide a toy for permitting an operator such as a child to attempt to control an object relative to a contour of variable elevation, as seen by the operator, while the toy and operator move relative to the contour. More specifically, the object may take the form of a toy airplane, for example, and I provide means by which the same may be suspended in a vehicle, such as an automobile, so that the child may sight along the object and control its apparent elevation relative to the contour of the surface of the terrain outside of the vehicle and in the operator's field of view, while the vehicle moves relative to the terrain.

According to one aspect of the invention, I provide a support, line bearing means carried by the support and means associated with the support, such as a suction cup for fixing the support to a vehicle window or other flat surface, so that the support may be mounted in the vehicle at a given height or position relative to the operator. The last named means may take the form of a spring clip for fixing the support to a sun visor or the like.

A flexible line such as a string is fixed at one end to the object, loops around the line bearing means and then through line guide means associated with the object, the free end of the line being adapted to be manipulated by the operator to raise and lower the object so that the operator may sight along the object and control the spatial relation of the object and the contour in his field of view as the contour moves relative to the object and operator, by manipulating the free end of the flexible line.

For example, if the object is a small model of an airplane, the operator may attempt to maintain the same at a given apparent altitude as the elevation of the terrain varies within the operator's field of view.

The support may comprise an elongate sleeve secured at one end to the suction cup, an arm extending within the other end of the sleeve for telescopic movement relative thereto and a finger pivotally connected at one end to the distal end of the arm and carrying the line bearing means at its other end. By this arrangement, the line bearing means may be pivoted relative to the suction cup so as to be carried in a given relation to the operator whether the cup is mounted on a side window or on the rear window of a station wagon having a rearwardly facing seat, for example. I may provide means such as a helical spring to urge the arm to its fully extended position relative to the sleeve. The telescopic arrangement and the arm urging means permit the device to contract in the event that it is struck by a vehicle occupant.

Thus, to manipulate the object relative to the terrain contour the object is mounted at a given height within the operator's field of view and closer to the operator than the contour, the operator sights along an imaginary line passing through the object and extending to a desired position relative to the contour. The operator then controls the elevation of the object relative to that of the contour, as seen by the operator, to maintain the object at the desired elevation relative to the contour within the operator's field of view, for example.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWING

Specific embodiments of the invention have been chosen for purposes of illustration and description, and are shown in the accompanying drawings, forming a part of the specification wherein:

FIG. 2 is an enlarged elevational view of the embodiment of the invention illustrated in FIG. 1;

FIG. 3 is a perspective view illustrating another embodiment of the invention; and FIG. 4 is a top plan view illustrating both modes of use of the embodiment shown in FIG. 3.

DESCRIPTION OF THE PREFERRED EMBODIMENTS

Figure 1:
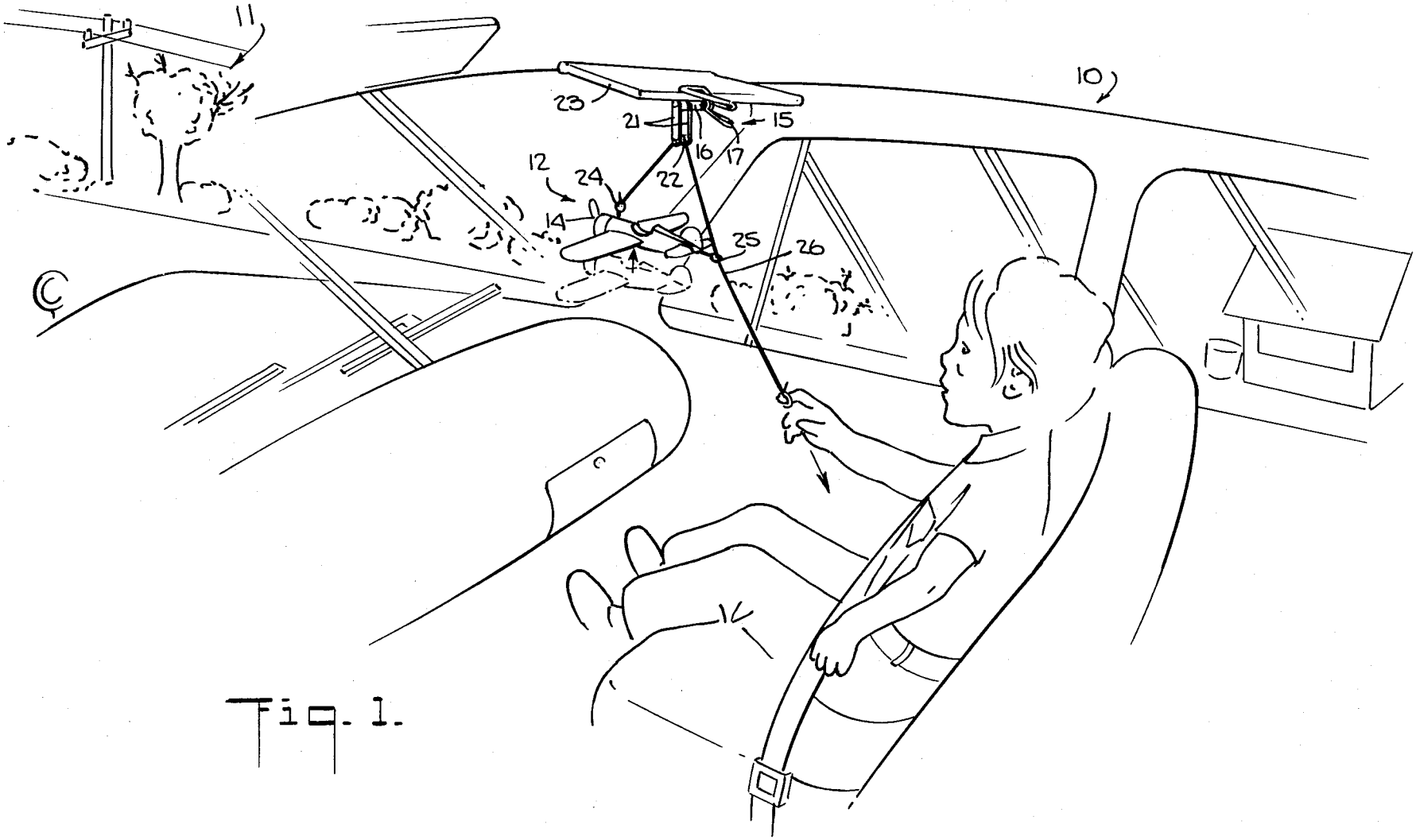
FIG. 1 is a perspective view illustrating one embodiment of the present invention in use by an operator in a moving automobile.

Referring now to FIG. 1, there is shown an automobile 10 traveling to the left, as viewed, and passing terrain 11 of varying elevation. As shown, the right front seat of the vehicle is occupied by a child in the act of operating the toy according to the first embodiment of the present invention.

The toy illustrated generally by the numeral 12 comprises an object 14 such as a miniature toy airplane, a support 15 comprising a cylindrical element such as a bar 16 arranged near one end to support a conventional spring clip 17. The opposite end of the bar 16 is recessed at 19, 20 (FIG. 2) to support one end of a pair of arms 21, the opposite ends of which carry between them line bearing means in the form of a pin 22. The arms 21 are supported by the bar 16 so as to be manually pivotable thereto but under sufficient friction normally to maintain the angular position, relative to the longitudinal axis of bar 16, to which it is set.

From the description thus far, it will be seen that the clip 17 may be fixed to a sun visor or the like and that the arms 21 may be adjusted angularly relative to the plane of the visor by reason of their frictional connection to the bar 16.

The object 14 is equipped with eyes 24, 25 conveniently located near the forward and rear ends thereof, respectively, to maintain the object in stable position simulating horizontal flight when a flexible line 26, such as a cord, is fixed at one end to the eye 24, loops or extends at least once around the pin 22 between arms 21, 23, the pin 22 constituting the line bearing means, then through the eye 25 and terminating in a free end for manipulation of the object 14 by an operator to raise and lower the object relative to a variable contour, such as the contour of the terrain 11 outside the vehicle, more distant from the operator than the object, both the contour and the object being within the operator's field of view.

A second embodiment of the invention is illustrated in FIG. 3 wherein the support is constituted by an elongate sleeve 30 secured to one end to a suction cup 31 by means of a ball and socket joint 32 that allows the sleeve to be positioned in any number of angular positions relative to the surface to which the suction cup 31 is fixed (in this case, the side or rear window of the vehicle 10). The support 15 further includes an arm 34 extending within the distal end of the sleeve 30 for telescopic movement relative to the sleeve 30, and a finger 35 pivotally connected by pin 36 to the distal end of the arm 34. A spring 37 within the sleeve 30 bears against an end of the arm 34 and urges it to its fully extended position, the same being limited by a tab 34A on arm 34 that projects into slot 30A in sleeve 30.

Line bearing means comprise a pair of spaced discs 39 mounted at the free end of the finger 35.

As shown in FIGS. 3 and 4, the finger 35 may extend axially of the arm 34 or it may extend at an angle thereto due to the pivot pin 36 so that the device may be fixed to a rear window 10A or a side window, 10B of a station wagon having a rearwardly facing seat, for example, at any desired position thereof for convenient operation by the child. The arm 34 and sleeve 30 are normally maintained in fully extended position by spring 37 while tab 34A and slot 30A define the limit of extension. The arm and sleeve can telescope for safety in case the child is caused physically to contact the device. It will be understood, of course, that where the operator is seated in a forwardly facing rear seat, the device of FIG. 3 may be attached to a side window of the vehicle with the object facing forward.

The toy of the embodiment of FIG. 3 is manipulated in a manner similar to that described with respect to the structure of FIGS. 1 and 2, the flexible line or cord 26 being looped around the finger 35 between the discs 39 instead of around the pin 22.

From the foregoing description of the respective embodiments, it will be seen that the object 14 may be manipulated relative to a contour of varying elevation as the contour moves relative to the object, by mounting the object at a given height within an operator's field of view and closer to the operator than the contour. The operator then sights along an imaginary line passing through or in the vicinity of the object and extending to a desired position relative to the contour, and varying the elevation of the object relative to the contour to maintain the object at a desired position relative to the contour within the operator's field of view. The object is of course raised by exerting a pulling force on the cord 26 and is lowered by gravity when the force on the cord is relaxed.

I believe that the structure and operation of my novel amusement device will now be understood and that the several advantages thereof will be fully appreciated by those persons skilled in the art.

I claim:

1. A toy for permitting an operator to attempt to control the position of an object relative to a contour of variable elevation while the toy and operator move relative to the contour, comprising, in combination:

a support including a sleeve, an arm projecting outwardly of one end of said sleeve and telescopically movable relative to said sleeve, means urging said arm to its full extension relative to said sleeve, a finger pivotally connected at one end to the distal end of said arm;

line bearing means carried by said finger and comprising spaced members of greater radial dimension than said finger to support the line therebetween;

means associated with said support for fixing said support at a given height relative to an operator;

an object to be moved between different heights relative to said support; and a flexible line fixed at one end to said object, looping around said finger between said spaced members and then through line guide means associated with said object and terminating in a free end for manipulation of said object relative to a variable contour more distant from said operator than said object, said contour and object being within the operator's field of view, whereby the operator may sight along the object and control the spatial relationship of the object and contour in his field of view as the contour moves relative to the object and operator by manipulation of the free end of said flexible line.

2. A toy for permitting an operator to attempt to control the position of an object relative to a contour of variable elevation while the toy and operator move relative to the contour, comprising, in combination:

a support;

line bearing means carried by said support;

means associated with said support for fixing said support at a given height relative to an operator;

an object to be moved between different heights relative to said support;

a flexible line fixed at one end to said object, looping around said line bearing means and then through line guide means associated with said object and terminating in a free end for manipulation of said object relative to a variable contour more distant from said operator than said object, said contour and object being within the operator's field of view;

said support comprising an elongate sleeve secured at one end to said support fixing means, an arm extending within the other end of said sleeve for telescopic movement relative thereto, a finger pivotally connected at one end to the distal end of said arm and carrying said line bearing means at its other free end and means for urging said arm to its full extension relative to said sleeve;

whereby the operator may sight along the object and control the spatial relationship of the object and contour in his field of view as the contour moves relative to the object and operator by manipulation of the free end of said flexible line.

* * * * *